US011320185B2

(12) United States Patent
Zhuo et al.

(10) Patent No.: US 11,320,185 B2
(45) Date of Patent: May 3, 2022

(54) DEFROSTING CONTROL METHOD FOR MULTI-SPLIT SYSTEM

(71) Applicant: QINGDAO HAIER AIR-CONDITIONING ELECTRONIC CO., LTD., Qingdao (CN)

(72) Inventors: Baitian Zhuo, Qingdao (CN); Bin Shi, Qingdao (CN); Shaojiang Cheng, Qingdao (CN); Ruigang Zhang, Qingdao (CN); Wanying Zhang, Qingdao (CN)

(73) Assignee: QINGDAO HAIER AIR-CONDITIONING ELECTRONIC CO., LTD., Qingdao (CN)

( * ) Notice: Subject to any disclaimer, the term of this patent is extended or adjusted under 35 U.S.C. 154(b) by 168 days.

(21) Appl. No.: 16/631,332

(22) PCT Filed: Jun. 21, 2018

(86) PCT No.: PCT/CN2018/092161

§ 371 (c)(1),
(2) Date: Jan. 15, 2020

(87) PCT Pub. No.: WO2019/015444

PCT Pub. Date: Jan. 24, 2019

(65) Prior Publication Data

US 2020/0208890 A1 Jul. 2, 2020

(30) Foreign Application Priority Data

Jul. 19, 2017 (CN) ..... 201710588909.7

(51) Int. Cl.
*F25B 47/02* (2006.01)
*F24F 11/43* (2018.01)
(Continued)

(52) U.S. Cl.
CPC ..... *F25B 47/02* (2013.01); *F24F 1/0007* (2013.01); *F24F 1/14* (2013.01); *F24F 11/42* (2018.01); *F24F 11/43* (2018.01)

(58) Field of Classification Search
CPC .... F25B 47/02; F25B 49/02; F25B 2313/006; F25B 2313/02331; F25B 2313/02332;
(Continued)

(56) References Cited

U.S. PATENT DOCUMENTS

2016/0161165 A1* 6/2016 Ushijima ..... F25D 21/006 62/155
2016/0223236 A1* 8/2016 Kimura ..... F25B 49/02
(Continued)

FOREIGN PATENT DOCUMENTS

CN 104061651 9/2014
CN 104266423 1/2015
(Continued)

*Primary Examiner* — Nelson J Nieves
(74) *Attorney, Agent, or Firm* — Jiwen Chen; Jacobson Holman PLLC

(57) ABSTRACT

A defrosting control method for a multi-split system is provided. A multi-split system comprises an outdoor unit and multiple indoor units. An expansion valve is provided on a connecting pipeline between each of the indoor units and the outdoor unit. When the expansion valve of each activated indoor unit is closed and the degree of opening of the expansion valve of each off-state indoor unit is less than or equal to a maximum set degree of opening, the system satisfies a defrosting requirement, and as a result the method controls the expansion valve of each activated indoor unit to remain closed, thereby resolving the issue of a dramatic temperature drop in a room having an activated indoor unit during defrosting and improving user satisfaction. The degree of opening of the expansion valve of a off-state indoor unit is Off_PLS, and is controlled such that Off_PLS=ALL_HP*Avg_PLS/Off_HP. The invention satisfies a defrosting requirement and reduces the degree of opening of the expansion valves as much as possible, thereby preventing damage to a compressor without affecting defrosting.

8 Claims, 3 Drawing Sheets

(51) Int. Cl.
*F24F 11/42* (2018.01)
*F24F 1/14* (2011.01)
*F24F 1/0007* (2019.01)

(58) Field of Classification Search
CPC .. F25B 2313/02334; F25B 2313/02741; F25B 2600/2513; F25B 2700/11; F24F 11/43; F24F 11/42; F24F 1/0007; F24F 1/14
See application file for complete search history.

(56) References Cited

U.S. PATENT DOCUMENTS

| | | | | |
|---|---|---|---|---|
| 2019/0063793 | A1* | 2/2019 | Tang | F25B 47/025 |
| 2020/0166233 | A1* | 5/2020 | Takagi | G05B 15/02 |
| 2021/0018236 | A1* | 1/2021 | Sanada | F24F 11/72 |

FOREIGN PATENT DOCUMENTS

| | | |
|---|---|---|
| CN | 104596032 | 5/2015 |
| CN | 105674648 | 6/2016 |
| CN | 106091505 | 11/2016 |
| CN | 106322580 | 1/2017 |
| JP | 2000179969 | 6/2000 |

* cited by examiner

DEFROSTING CONTROL METHOD FOR MULTI-SPLIT SYSTEM

This is a U.S. national stage application of PCT Application No. PCT/CN2018/092161 under 35 U.S.C. 371, filed Jun. 21, 2018 in Chinese, claiming priority of Chinese Application No. 201710588909.7, filed Jul. 19, 2017, all of which are hereby incorporated by reference.

TECHNICAL FIELD

The invention belongs to the technical field of air conditioning, and in particular relates to a defrosting control method for multi-split system.

BACKGROUND

A typical multi-split system includes an outdoor unit connected to a plurality of indoor units working independently. Each of the indoor units is provided with an expansive valve configured to adjust the amount of refrigerant flowing into indoor exchanger, and the indoor exchanger transfer heat with the outside.

As the multi-split system working in a heating mode, frost may form on the surface of the outdoor unit if the outdoor temperature is low, and further exacerbate heat loss. It is necessary to enter a defrost mode to defrost the outdoor unit and then back to normal heating operation. During the defrost mode, the multi-split system is running at a cold mode in which all of the indoor units, regardless of working or not, are operating to cool the environment such as to maintain the opening degree of the expansion valves are same. In this way, the indoor temperature of rooms where the indoor units working are decreased rapidly, which will affect user experience.

SUMMARY OF THE INVENTION

The present invention provides a defrosting control method for multi-split system to solve the problem that during the defrost mode the indoor temperature of rooms where the indoor units working may be decreased rapidly, and also to improve user experience.

In order to solve the above technical problems, the present invention is implemented by the following technical solutions:

A defrosting control method for multi-split system, wherein the multi-split system includes an outdoor unit and a plurality of indoor units, an expansion valve is disposed on each of connecting pipes between one of the indoor units and the outdoor unit;

The control method includes:

Determining whether or not satisfying a defrost condition;

If satisfying the defrost condition, determining whether or not satisfying a defrosting requirement under a condition that expansion valves on working indoor units are closed and the opening degree of each of expansion valves of off-state indoor units≤a maximum set opening degree offLimitMaxPLS;

If satisfying the defrost requirement, closing the expansion valves of the working indoor units and adjusting the opening degree of each of the expansion valves of the off-state indoor units to Off_PLS, wherein $$Off_PLS=ALL_HP*Avg_PLS/Off_HP;$$

in which:

Off_HP denoting a total capacity of the off-state indoor units;

Off_PLS denoting an opening degree of each of the expansion valves of the off-state indoor units;

offLimitMaxPLS denoting a maximum set opening degree of each of the expansion valves on the off-state indoor units;

ALL_HP denoting a total capacity of the indoor units, and;

Avg_PLS denoting a set average opening degree, which indicates that if the opening degree of each of the expansion valves of the indoor units is the set average opening degree the multi-split system satisfying the defrosting requirement.

Further, determining whether or not satisfying the defrosting requirement by determining if (Off_HP*offLimitMaxPLS)≥ALL_HP*Avg_PLS under a condition that the expansion valves of the working indoor units are closed and the opening degree of each of the expansion valves of the off-state indoor units ≤the maximum set opening degree offLimitMaxPLS.

Further, the control method further includes:

If the defrosting requirement is not satisfied under a condition that each of the expansion valves of the working indoor units are closed and the opening degree of each of the expansion valves of the off-state indoor units ≤the maximum set opening degree offLimitMaxPLS;

Adjusting the opening degree of each of the expansion valves of the off-state indoor units to the maximum set opening degree offLimitMaxPLS; and Adjusting the opening degree of each of the expansion valves of the working indoor units to On_PLS; wherein $$On_PLS=(ALL_HP*Avg_PLS-Off_HP*offLimitMaxPLS)/On_HP;$$

in which,

On_HP denoting the total capacity of the working indoor units;

On_PLS denoting the opening degree of each of the expansion valves of the working indoor units.

Further, the control method further includes: separating the indoor units into normal indoor units and VIP indoor units;

If the defrosting requirement is not satisfied under a condition that each of the expansion valves of the working indoor units are closed and the opening degree of each of the expansion valves of the off-state indoor units ≤the maximum set opening degree offLimitMaxPLS;

determining whether or not the defrosting requirement is satisfied under a condition that the opening degree of each of the expansion valves of the off-state indoor units is the maximum set opening degree offLimitMaxPLS, the opening degree of each of expansion valves of working normal indoor units≤a maximum set opening degree onLimitMaxPLS, and each of expansion valves of working VIP indoor units are closed;

if the defrosting requirement is satisfied, adjusting the opening degree of each of the expansion valves of the off-state indoor units to the maximum set opening degree offLimitMaxPLS;

adjusting the opening degree of each of the expansion valves of the working normal indoor units to a NormalOn_PLS; wherein $$NormalOn_PLS=(ALL_HP*Avg_PLS-Off_HP*offLimitMaxPLS)/NormalOn_HP;\ \text{and}$$

closing each of the expansion valves of the working VIP indoor units;

in which,

NormalOn_HP denoting a total capacity of the working normal indoor units;

NormalOn_PLS denoting the opening degree of each of the expansion valves of the working normal indoor units, and onLimitMaxPLS denoting a maximum set opening degree of each of the expansion valves of the normal working indoor units.

Further, the step for determining whether or not the defrosting requirement is satisfied under the condition that the opening degree of each of the expansion valves of the off-state indoor units is the maximum set opening degree offLimitMaxPLS, the opening degree of each of expansion valves of the working normal indoor units≤a maximum set opening degree onLimitMaxPLS, and each of expansion valves of working VIP indoor units are closed includes:

Determining if (Off_HP*offLimitMaxPLS)+(NormalOn_HP*onLimitMaxPLS)≤ALL_HP*Avg_PLS.

Preferably, if the defrosting requirement is not satisfied under the condition that the opening degree of each of the expansion valves of the off-state indoor units is the maximum set opening degree offLimitMaxPLS, the opening degree of each of expansion valves of the working normal indoor units≤the maximum set opening degree onLimitMaxPLS, and each of expansion valves of working VIP indoor units are closed;

Adjusting the opening degree of each of the expansion valves of the off-state indoor units to the maximum set opening degree offLimitMaxPLS;

Adjusting the opening degree of each of the expansion valves of the working normal indoor units to the maximum set opening degree onLimitMaxPLS;

adjusting the opening degree of each of the expansion valves of the working VIP indoor units to VIP_PLS, wherein $$VIP_PLS=(ALL_HP*Avg_PLS-Off_HP*offLimitMaxPLS-NormalOn_HP*onLimitMaxPLS)/VIP_HP;$$

in which,

VIP_HP denoting a total capacity of the working VIP indoor units;

VIP_PLS denoting an opening degree of each of the expansion valves of the working VIP indoor units.

Further, the maximum set opening degree of each of the expansion valves of the off-state indoor units offLimitMaxPLS=K1*Avg_PLS, 2≤K1≤3.

Further, K1=2.

Further, the maximum set opening degree of each of the expansion valves of the working normal indoor units onLimitMaxPLS=K2*Avg_PLS, 1≤K2<2.

Further, K2=1.5.

Compared with the prior art, the advantages and positive effects of the present invention are: with the defrosting control method for multi-split system disclosed by the present embodiment, the problem that the indoor temperature where the working indoor units are drops significantly could be solved by closing those expansion valves of the working indoor units as the defrosting requirement of the system is satisfied under the condition that the opening degrees of each of those expansion valves of the off-state indoor units are less than or equal to the maximum set opening degree, so as to improve user experience. The method also solve problems of compressor damage and being worsening in defrosting effect by adjusting the opening degree of those expansion valves of those expansion valves of the off-state indoor units as Off_PLS=ALL_HP*Avg_PLS/Off_HP and in the meanwhile the defrosting requirement of the system is satisfied.

Other features and advantages of the present invention will become apparent from the Detailed Description of the Drawing.

DETAILED DESCRIPTION OF THE INVENTION

The present invention will be further described in detail below with reference to the accompanying drawings and embodiments.

Figure 1:
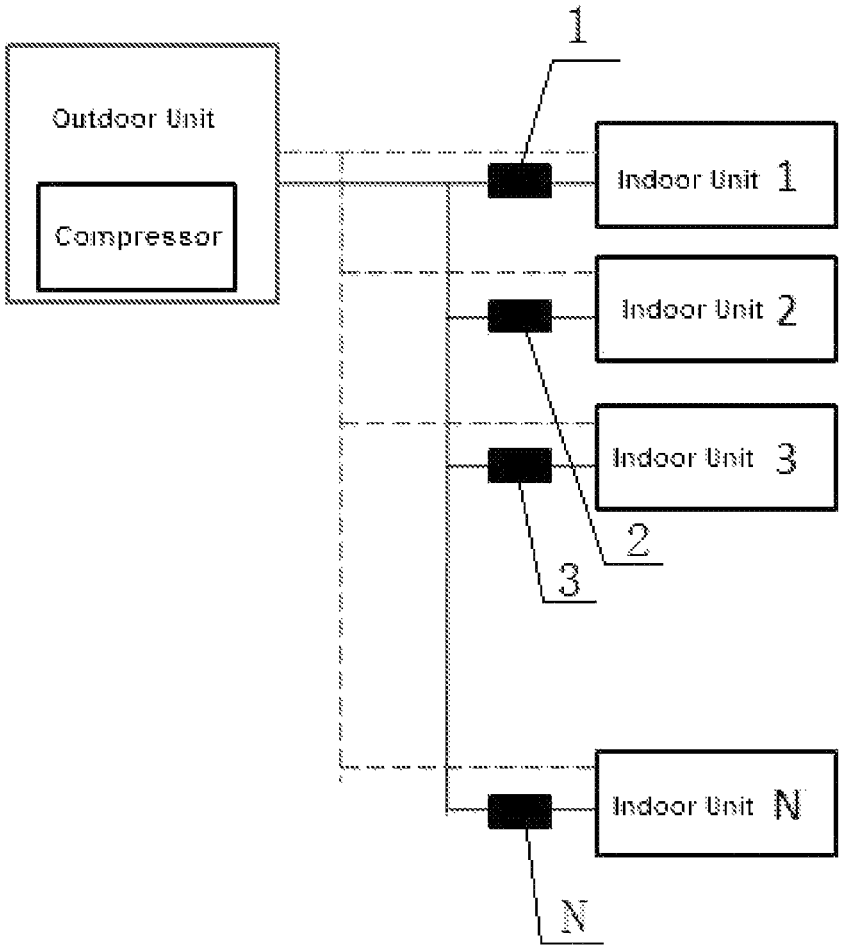
FIG. 1 is a block diagram showing the structure of a multi-split system.

FIG. 1 shows the structure of a multi-split system, and the multi-split system includes an outdoor unit and a plurality of indoor units; wherein an expansion valve is mounted on each of the connecting pipe between one of the indoor units and the outdoor unit. The expansion valve is disposed on an indoor unit liquid pipe in which liquid refrigerate flowing so as to adjust the amount of refrigerant entering the indoor unit. The indoor unit liquid pipe is communicated with an outdoor unit liquid pipe. As shown in FIG. 1, an expansion valve 1 is disposed on a liquid pipe of the indoor unit 1, an expansion valve 2 is disposed on a liquid pipe of the indoor unit 2, and an expansion valve 3 is disposed on a liquid pipe of the indoor unit 3 . . . . , an expansion valve N is disposed on a liquid pipe of the indoor unit N.

The steps of the opening degrees of all of the expansion valves on indoor units are same. If the expansion valve is in a closed state, the opening degree is 0 step; if the expansion valve are in a full opening state, the opening degree is 500 step. However, the diameters of the expansion valves are different, the larger the capacity of the indoor units, the larger of the diameter of the expansion valve on the indoor unit.

Figure 2:
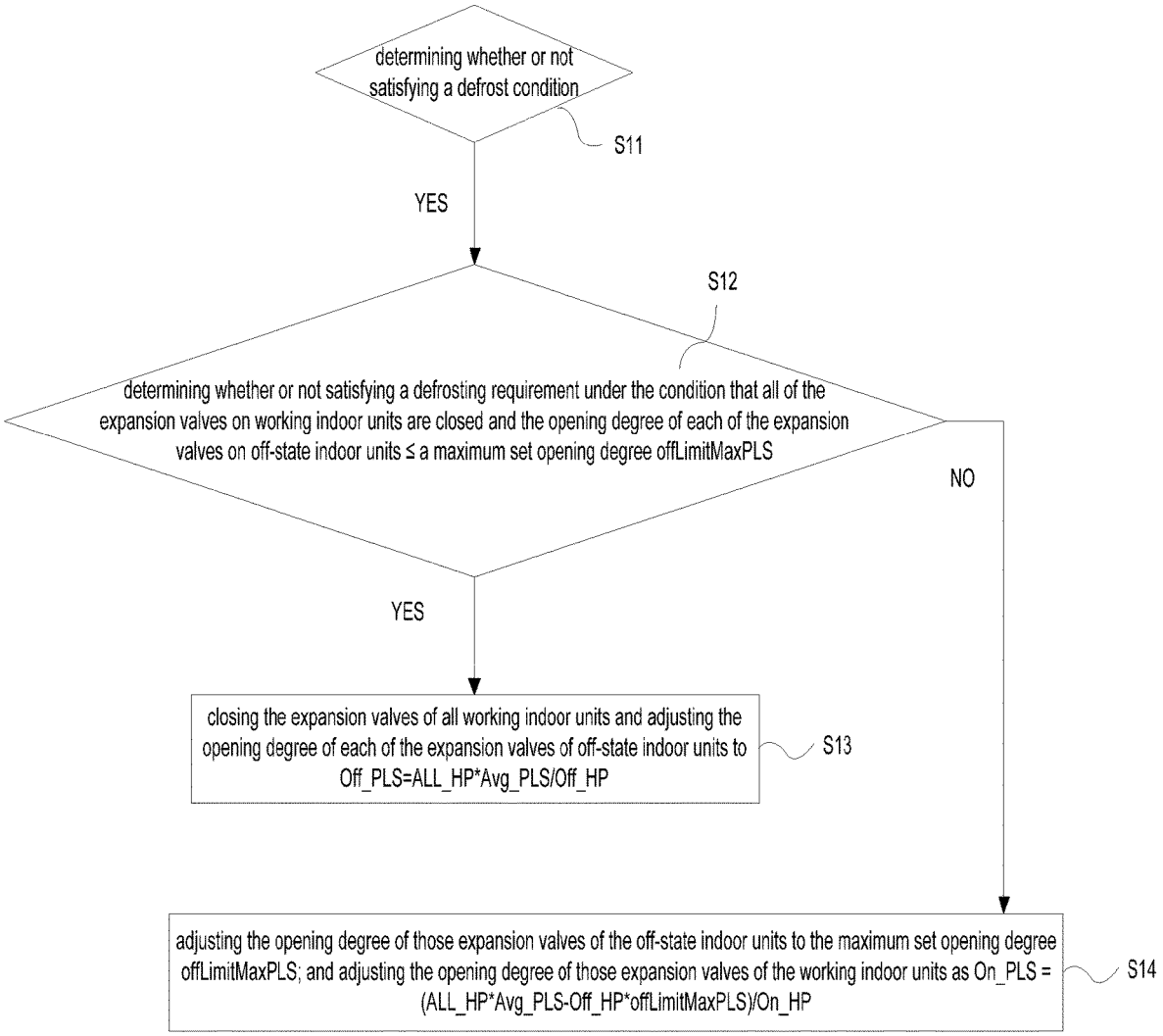
FIG. 2 is a flow chart of a defrosting control method for multi-split system according to one embodiment of the present invention.

A defrosting control method for multi-split system according to one embodiment of the preset invention is shown in FIG. 2. The defrosting control method mainly comprises following steps:

Step S11: determining whether or not satisfying a defrost condition.

A temperature sensor is arranged on a heat exchanger of the outdoor unit, which is configured to obtain the temperature of the outdoor unit heat exchanger. If a detected temperature≤a set temperature, it is determined that a defrost condition is satisfied and then starting a defrost mode; otherwise it is determined that the defrost condition is not satisfied and maintaining a normal operation.

If the defrosting condition is satisfied, a four-way valve switches to a different position so as to enable the heating mode to be changed to the cooling mode and all of indoor fans are turned off, and performing Step 12.

Step S12: determining whether or not satisfying a defrosting requirement under the condition that all of the expansion valves on working indoor units are closed and the opening degree of each of the expansion valves on off-state indoor units≤a maximum set opening degree offLimitMaxPLS.

If the defrosting requirement is satisfied, that is to say achieving a required defrosting effect, performing Step S13

In the present embodiment, whether or not satisfying the defrosting requirement is determined by if (Off_HP*offLimitMaxPLS)≥ALL_HP*Avg_PLS. In fact, the indoor unit capacities are different, with the same opening degree of the expansion valves, the flow rates of refrigerant are varied, so the defrosting effects are different. Hence, as determining whether or not satisfying the defrosting requirement, the capacities of the indoor units are preferably considered so as to evaluate the defrost effect in a more reasonable way.

In which, Off_HP denotes a total capacity of all off-state indoor units, that is to say a sum of the capacities of all of the off-state indoor units, and offLimitMaxPLS denotes the maximum set opening degree of each of those expansion valves of the off-state indoor units.

ALL_HP denotes a total capacity of all indoor units, that is to say a sum of the capacities of all of the indoor units. Avg_PLS denotes a set average opening degree. If the opening degree of each of the expansion valves of all indoor units is the set average opening degree, the multi-split system satisfies the defrosting requirement. The Avg_PLS is obtained from preset experiments during which all of the opening degrees of the expansion valves of all indoor units (including those working or at off states) are set to an uniform opening degree so as to detect whether or not the defrost of the outdoor unit heat exchanger could be completed during a preset period; if the defrost of the outdoor unit heat exchanger could be completed, it suggests that, with the current uniform opening degree, the defrosting requirement of the multi-split system could be satisfied to fulfill a required defrosting effect, and then the current uniform opening degree is set as the set average opening degree. For example, during a preset experiment, all of the opening degrees of the expansion valves of all indoor units are set as 150 steps, if the defrost of the outdoor unit heat exchanger could completed during the preset period, such as 5 minutes, the set average opening degree is set as 150 steps.

Step S13: closing the expansion valves of all working indoor units and adjusting the opening degree of each of the expansion valves of off-state indoor units to Off_PLS=ALL_HP*Avg_PLS/Off_HP.

The amount of refrigerant flowing into indoor unit heat exchanger is being adjusted by the expansion valve. On one hand, if too much refrigerant flowing into the indoor unit heat exchanger, the heat exchange between the refrigerant and the indoor environment may be insufficient such that the heat of the room where the indoor unit disposed in could not be properly transfer to the refrigerant and then used to defrost the ice of the outdoor unit for achieving a required defrosting effect. If the ice could not completely melt, the outdoor unit may frost again soon after back to normal heating operation and leading to a gradual worsening heating performance. In order to avoid that situation, as satisfying the defrosting requirement, the opening degree of expansion valves of indoor units are preferably set as small as possible meanwhile because the smaller the opening degree of the expansion valve, the smaller heat could be transferred to the refrigerant such that the indoor temperature could be maintained without severe variation. On the other hand, if each of those expansion valves of off-state indoor units are fully opened, that is to say adjusting the opening degree to a fully open degree, without consideration of different capacities of the indoor unit heat exchangers and the defrosting requirement of the outdoor unit, the refrigerant may be unable to fully absorb the heat from the environment where the indoor unit are such that a large part of liquid refrigerant not evaporating may directly flow into compressor causing damage. In order to avoid those problems, it is better to calculate an opening degree Off_PLS for those expansion valves of off-state indoor units instead of adjusting the opening degree in direct to the maximum set opening degree offLimitMaxPLS even the defrosting requirement could be satisfied under the condition that all of the expansion valves of the working indoor units are closed and all of the expansion valves of the off-state indoor units are set as the maximum set opening degree offLimitMaxPLS. In this way, while satisfying the defrosting requirement, the opening degree of the expansion valves of those off-state indoor units could be maintained comparatively smaller so as to avoid the worsening defrost effect caused by insufficient heat exchange. Off_PLS denotes the opening degree of the expansion valve of the off-state indoor unit.

Generally, if (Off_HP*offLimitMaxPLS) ≥ALL_HP*Avg_PLS, those expansion valves of the working indoor units are closed and the opening degree of each of those expansion valves of the off-state indoor units are set as Off_PLS; wherein $$Off_PLS = ALL_HP * Avg_PLS / Off_HP, \text{ wherein } Off_PLS \leq offLimitMaxPLS.$$

With the defrosting control method for multi-split system disclosed by the present embodiment, the problem that the indoor temperature where the working indoor units are drops significantly could be solved by closing those expansion valves of the working indoor units as the defrosting requirement of the system is satisfied under the condition that the opening degrees of each of those expansion valves of the off-state indoor units are less than or equal to the maximum set opening degree, so as to improve user experience. The method also solve problems of compressor damage and being worsening in defrosting effect by adjusting the opening degree of those expansion valves of those expansion valves of the off-state indoor units as Off_PLS=ALL_HP*Avg_PLS/Off_HP and in the meanwhile the defrosting requirement of the system is satisfied.

The defrosting control method for multi-split system disclosed by the present embodiment could dynamically calculate the opening degree of the expansion valve of each of the indoor unit according to its real-time on-off states, and hence on one hand the impact on the indoor temperature caused by defrosting could be minimized, on the other hand the defrost requirement of the outdoor unit could be satisfied.

In this embodiment, if the defrosting requirement is not satisfied, that is to say (Off_HP*offLimitMaxPLS) <ALL_HP*Avg_PLS under the condition that each of those expansion valves of the working indoor units are closed and the opening degree of each of those expansion valves of the off-state indoor units are less than or equal to the maximum opening degree offLimitMaxPLS, performing Step 14.

Step S14: adjusting the opening degree of those expansion valves of the off-state indoor units to the maximum set opening degree offLimitMaxPLS; and adjusting the opening degree of those expansion valves of the working indoor units as On_PLS=(ALL_HP*Avg_PLS−Off_HP*offLimitMaxPLS)/On_HP, wherein On_HP denotes the total capacity of all of the working indoor units and On_PLS denotes the opening degree of those expansion valves of the working indoor units.

If the defrost requirement could not be satisfied by merely adjusting the opening degree of those expansion valves of the off-state indoor units to the maximum set opening degree offLimitMaxPLS, those expansion valves of the working indoor units should be opened as well. Taking the worsening effect of the indoor temperature into consideration, it is preferable to fully make use of the adjustment effect of those off-state indoor units. Hence, adjusting the opening degree of each of those expansion valves of the off-state indoor units to the maximum set opening degree offLimitMaxPLS and adjusting the opening degree of each of those expansion valves of working indoor units to an average opening degree, that is to say adjusting the opening degree of each of those expansion valves of the working indoor units as On_PLS, On_PLS=(ALL_HP*Avg_PLS−Off_HP*offLimitMaxPLS)/On_HP; and hence the defrosting requirement is satisfied and the influence on the room temperature where working indoor units in could be minimized.

As a preferred embodiment, the indoor units could be separated into normal indoor units and VIP indoor units. During the defrosting mode, the priority is to maintain the temperature of the rooms where the VIP indoor units are not being influenced.

Figure 3:
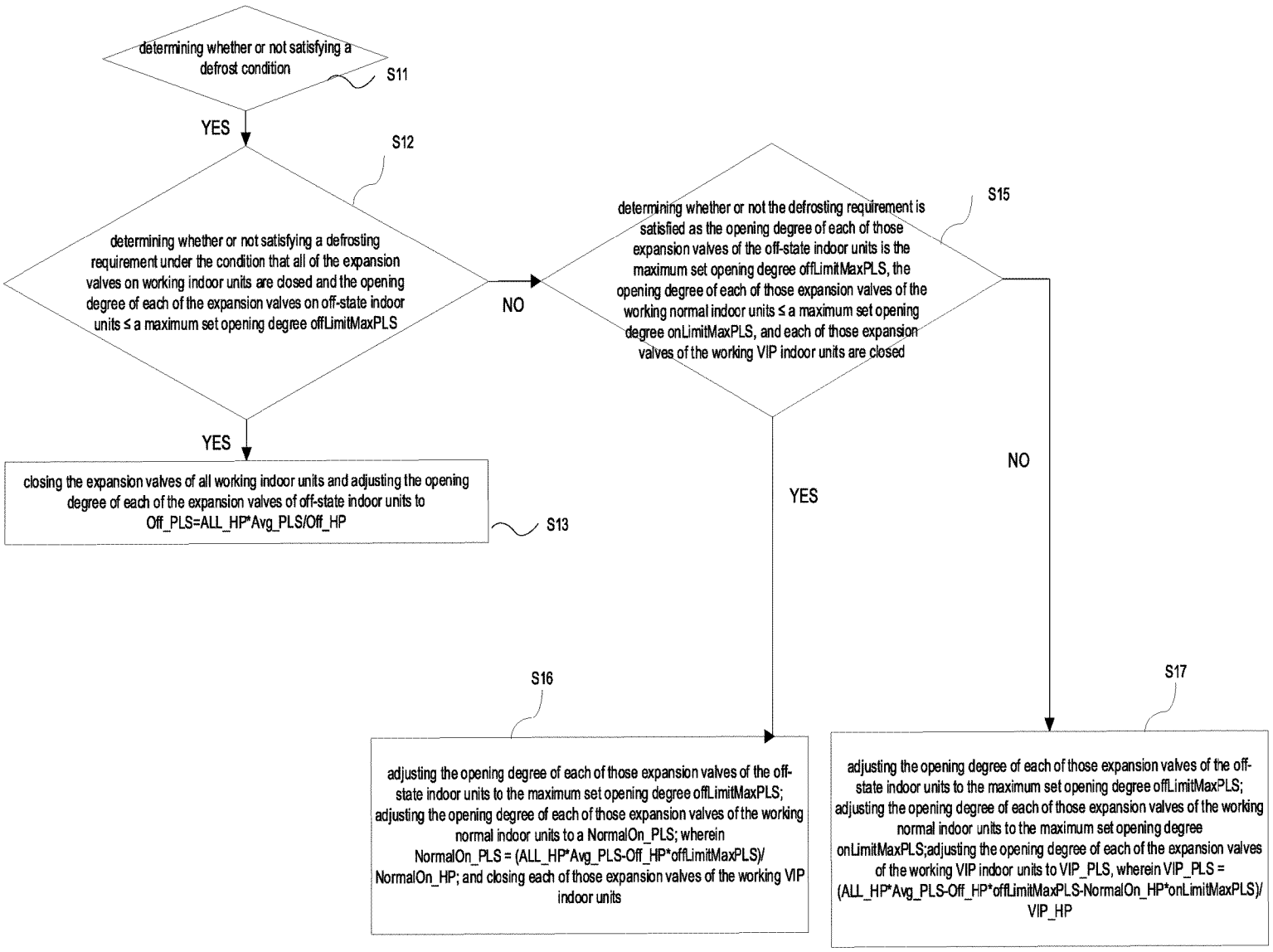
FIG. 3 is a flow chart of a defrosting control method for multi-split system according to another embodiment of the present invention.

If the defrosting requirement is not satisfied, that is to say (Off_HP*offLimitMaxPLS)<ALL_HP*Avg_PLS under the condition that each of those expansion valves of working indoor units are closed and the opening degree of each of those expansion valves of the off-state indoor units≤the maximum setting opening offLimitMaxPLS, performing Step S15, as shown in FIG. 3.

Step S15: determining whether or not the defrosting requirement is satisfied as the opening degree of each of those expansion valves of the off-state indoor units is the maximum set opening degree offLimitMaxPLS, the opening degree of each of those expansion valves of the working normal indoor units≤a maximum set opening degree onLimitMaxPLS, and each of those expansion valves of the working VIP indoor units are closed.

In this embodiment, if (Off_HP*offLimitMaxPLS)+
(NormalOn_HP*onLimitMaxPLS)
≥ALL_HP*Avg_PLS the defrosting requirement is satisfied. The capacities of indoor units are different, and the amount of refrigerant are varied under a uniform expansion valve opening degree. Hence, this method provides a reasonable way by considering into the capacities of the indoor units.

If (Off_HP*offLimitMaxPLS)+
(NormalOn_HP*onLimitMaxPLS)
≥ALL_HP*Avg_PLS, the defrosting requirement could be satisfied without opening the expansion valves of the working VIP indoor units, then performing S16.

If (Off_HP*offLimitMaxPLS)+
(NormalOn_HP*onLimitMaxPLS)
<ALL_HP*Avg_PLS, the defrosting requirement merely could be satisfied by opening the expansion valves of the working VIP indoor units, then performing S17.

Step S16: adjusting the opening degree of each of those expansion valves of the off-state indoor units to the maximum set opening degree offLimitMaxPLS; adjusting the opening degree of each of those expansion valves of the working normal indoor units to a NormalOn_PLS; wherein NormalOn_PLS=(ALL_HP*Avg_PLS−Off_HP*offLimitMaxPLS)/NormalOn_HP; and closing each of those expansion valves of the working VIP indoor units.

Wherein NormalOn_HP denotes a total capacity of all of the working normal indoor units; NormalOn_PLS denotes the opening degree of each of those expansion valves of working normal indoor units, and onLimitMaxPLS denotes a maximum set opening degree of each of those expansion valves of normal working indoor units.

If the defrosting requirement could be satisfied by adjusting the opening degree of each of those expansion valves of all off-state indoor units to the maximum set opening degree offLimitMaxPLS and adjusting the opening degree of each of those expansion valves of working normal indoor unit-≤the maximum set opening onLimitMaxPLS, the influence on the temperature of the rooms where the working normal indoor units in could be reduced by decreasing the opening degree of those expansion valves of working normal indoor units, that is to say, to adjust the opening degree of each of those expansion valves of the working normal indoor units to NormalOn_PLS, wherein NormalOn_PLS=(ALL_HP*Avg_PLS−Off_HP*offLimitMaxPLS)/NormalOn_HP. In this way, the defrosting requirement could be satisfied, and in the meanwhile, the influence on the temperature of the rooms where working normal indoor units in could be minimized and no impact on the temperature of those rooms where VIP indoor units are.

Step S17: adjusting the opening degree of each of those expansion valves of the off-state indoor units to the maximum set opening degree offLimitMaxPLS; adjusting the opening degree of each of those expansion valves of the working normal indoor units to the maximum set opening degree onLimitMaxPLS;

adjusting the opening degree of each of those expansion valves of the working VIP indoor units to VIP_PLS, VIP_PLS=(ALL_HP*Avg_PLS−
Off_HP*offLimitMaxPLS−
NormalOn_HP*onLimitMaxPLS)/VIP_HP.

Wherein, VIP_HP denotes a total capacity of all working VIP indoor units; VIP_PLS denotes an opening degree of each of those expansion valves of working VIP indoor units.

After adjusting each of those expansion valves of all of off-state indoor units to the maximum set opening offLimitMaxPLS and adjusting each of those expansion valves of all of working normal indoor units to the maximum set opening onLimitMaxPLS, the defrosting requirement still may not be satisfied. Under this condition, although the expansion valves of those working VIP indoor units should be opened, the opening degree have to be minimized so as to restrict the impact on the temperature of the rooms where the working VIP indoor units are. It is preferable to adjust the opening degree of each of those expansion valves of working VIP indoor units to VIP_PLS, wherein $$VIP_PLS=(ALL_HP*Avg_PLS-Off_HP*offLimitMaxPLS-NormalOn_HP*onLimitMaxPLS)/VIP_HP;$$

and in this way, the defrosting requirement could be satisfied and the influence on the temperature of the room where the working VIP indoor units are could be minimized.

In the present embodiment, the maximum set opening degree of each of those expansion valves of the off-state indoor units offLimitMaxPLS is less than the opening degree when the expansion valve is fully opened, offLimitMaxPLS=K1*Avg_PLS, $2 \leq K1 \leq 3$. The maximum set opening degree of each of those expansion valves of the off-state indoor units within the range could fully utilize the heat exchange capacities of off-state indoor units to defrost, and meanwhile avoid the risk of compressor damage caused by adjusting the opening degree to excess. As a preferred embodiment, K1=2, and offLimitMaxPLS=2*Avg_PLS, which not only could fully utilize the off-state indoor unit for defrosting, but also ensures the defrosting effect, and avoids the risk of compressor damage due to liquid refrigerant flowing into.

In the present embodiment, the maximum set opening degree of each of those expansion valves of the working normal indoor units onLimitMaxPLS is less than the opening degree when the expansion valve is fully opened, onLimitMaxPLS=K2*Avg_PLS, $1 \leq K2 \leq 2$. The maximum set opening degree of each of those expansion valves of the working normal indoor units within the range could not only utilize the heat exchange capacities of working normal indoor units to defrost, but also could avoid the drop of temperature of the rooms where working normal indoor units are. As a preferred embodiment, K2=1.5, and onLimitMaxPLS=1.5*Avg_PLS, which not only could utilize the working normal indoor units for defrosting, but also ensures the defrosting effect, and avoids the drop of temperature of the rooms where working normal indoor units are.

For example, when the expansion valve is fully opened, the opening degree is 500 steps, the Avg_PLS is 150 steps, the offLimitMaxPLS is 300 steps, and the onLimitMaxPLS is 225 steps.

The aim of the defrosting control method of the embodiment gives priority to the comfort of the user in rooms where VIP indoor units are, and secondly to the comfort of the user in rooms where normal indoor units are, thereby ensuring the defrost effect and minimizing the impact on temperature of rooms where working indoor units are during the defrosting process, so as to improve user satisfaction.

A formula for calculating an opening degree of each of expansion valves of indoor units during defrosting process is provided:

$$(VIP_HP*VIP_PLS)+(NormalOn_HP*NormalOn_PLS)+(Off_HP*Off_PLS)=ALL_HP*Avg_PLS.$$

Under normal circumstances, VIP_PLS could be set to 0. That is to say, only under the condition that the defrosting requirement still could not be satisfied with both of the opening degree of each of those expansion valves of working normal indoor units and the opening degree of each of those expansion valves of off-state indoor units are the maximum set opening degree, the expansion valves of the working VIP indoor units are opened to ensure defrosting effect.

Taking eight indoor units as an example, the defrosting control method includes the following steps:

TABLE 1

| Indoor Unit Number | 1# | 2# | 3# | 4# | 5# | 6# | 7# | 8# |
|---|---|---|---|---|---|---|---|---|
| Capacity HP | 2 | 1 | 3 | 2.5 | 2 | 1.5 | 3 | 5 |
| VIP Mark | NO | YES | NO | NO | NO | NO | YES | NO |

The total capacity of all indoor units is ALL_HP=2+1+3+2.5+2+1.5+3+5=20.

Setting Avg_PLS=150, onLimitMaxPLS=225 and offLimitMaxPLS=300.

ALL_HP*Avg_PLS=20*150.

Condition 1:

| Indoor Unit Number | 1# | 2# | 3# | 4# | 5# | 6# | 7# | 8# |
|---|---|---|---|---|---|---|---|---|
| On-Off Mark | ON | OFF | OFF | OFF | ON | ON | ON | OFF |
| Opening Degree of Expansion Valve | 0 | 261 | 261 | 261 | 0 | 0 | 0 | 261 |

The total capacity of all off-state indoor units is Off_HP=1+3+2.5+5=11.5, which is the sum of the capacities of 2 #, 3 #, 4 #, 8 # indoor units.

The total capacity of all working normal indoor units is NormalOn_HP=2+2+1.5=5.5, which is the sum of capacities of 1 #, 5 #, 6 # indoor units.

The total capacity of all working VIP indoor units is VIP_HP=3, which is the capacity of 7 # indoor unit because 3 # indoor unit is not working.

Since 11.5*300>20*150, the defrost requirement can be satisfied by merely opening the expansion valves of those off-state indoor units, VIP_PLS=0, NormalOn_PLS=0, Off_PLS=(20*150)/11.5=261<300.

That is to say, when VIP_PLS=0 and NormalOn_PLS=0, Off_PLS=(20*150)/11.5=261<300, the defrosting requirement is satisfied and also the heating performance of the working VIP indoor units and the working normal indoor units could be ensured to avoid the drop of room temperature.

Condition 2

| Indoor Unit Number | 1# | 2# | 3# | 4# | 5# | 6# | 7# | 8# |
|---|---|---|---|---|---|---|---|---|
| On-Off Mark | ON | OFF | ON | OFF | ON | ON | ON | OFF |
| Opening Degree of Expansion Valve | 53 | 300 | 53 | 300 | 53 | 300 | 0 | 300 |

The total capacity of all of the off-state indoor units is Off_HP=1+2.5+5=8.5, which is the sum of the capacities of 2 #, 4 #, and 8 # indoor units.

The total capacity of all working normal indoor units is NormalOn_HP=2+3+2+1.5=8.5, which is the sum of the capacities of 1 #, 3 #, 5 #, and 6 # indoor units.

The total capacity of all working VIP indoor units is VIP_HP=3, which is the capacity of 7 # indoor unit.

Since 8.5*300<20*150, 8.5*300+8.5*225>20*150, the defrosting requirement can be satisfied by opening the expansion valves of those off-state indoor units and the expansion valves of those working normal indoor units, VIP_PLS=0, Off_PLS=300, NormalOn_PLS=((20*150)−(8.5*300))/8.5=53<225.

That is to say, when VIP_PLS=0 and NormalOn_PLS=0, Off_PLS=(20*150)/8.5=353>300, which is beyond the maximum set opening degree and unable to satisfy the defrosting requirement of the multi-split system. The expansion valves of those working normal indoor units need to be opened and the method gives priority to maintain the temperature of rooms where the working VIP indoor units are. Then it could be obtained that NormalOn_PLS=((20*150)−(8.5*300))/8.5=53<225 as VIP_PLS=0 and Off_PLS=300.

Condition 3: 1 # and 5 # are added as VIP indoor units.

| Indoor Unit Number | 1# | 2# | 3# | 4# | 5# | 6# | 7# | 8# |
|---|---|---|---|---|---|---|---|---|
| Capacity HP | 2 | 1 | 3 | 2.5 | 2 | 1.5 | 3 | 5 |
| VIP Mark | YES | YES | NO | NO | YES | NO | YES | NO |
| On-Off Mark | ON | ON | ON | ON | ON | ON | ON | ON |
| Opening Degree of Expansion Valve | 38 | 38 | 225 | 225 | 38 | 225 | 38 | 225 |

The total capacity of all off-state indoor units is Off_HP=0.

The total capacity of all working general indoor units is NormalOn_HP=3+2.5+1.5+5=12, which is the sum of the capacities of 3 #, 4 #, 6 #, 8 # indoor units.

The total capacity of all working VIP indoor units is VIP_HP=2+1+2+3=8, which is the sum of the number of the capacities of 1 #, 2 #, 5 #, and 7 # indoor units.

Since 12*225<20*150, the defrost requirement only could be satisfied by opening both of the working normal indoor units and the working VIP indoor units, NormalOn_PLS=225, VIP_PLS=((20*150)−(12*225))/8=38.

That is to say, when VIP_PLS=0, Off_PLS=300, NormalOn_PLS=(20*150)/12=250>225, which is beyond the maximum set opening degree and unable to satisfy the defrosting requirement of the multi-split system or the drop of temperature of rooms where working normal indoor units are is significant. The expansion valves of those working VIP indoor units need to be opened to balance the system. Then it could be obtained VIP_PLS=((20*150)−(12*225))/8=38, as Off_PLS=300 and NormalOn_PLS=225

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What we claimed is:

1. A defrosting control method for multi-split system in need of defrosting, wherein the multi-split system includes an outdoor unit and a plurality of indoor units, an expansion valve is disposed on each of connecting pipes between one of the indoor units and the outdoor unit, includes:

step (1): determining whether or not a defrosting requirement is satisfied under a condition that expansion valves on working indoor units are closed and the opening degree of each of expansion valves of off-state indoor units≤a maximum set opening degree offLimitMaxPLS;

step (2): performing step (2a) or step (2b) as follows:

step (2a): if the defrost requirement is satisfied, closing the expansion valves of the working indoor units and adjusting the opening degree of each of the expansion valves of the off-state indoor units to Off_PLS, wherein $$Off_PLS=ALL_HP*Avg_PLS/Off_HP;$$

in which:

Off_HP denoting a total capacity of the off-state indoor units;

Off_PLS denoting an opening degree of each of the expansion valves of the off-state indoor units;

offLimitMaxPLS denoting a maximum set opening degree of each of the expansion valves on the off-state indoor units;

ALL_HP denoting a total capacity of the indoor units, and

Avg_PLS denoting a set average opening degree, which indicates that if the opening degree of each of the expansion valves of the indoor units is the set average opening degree the multi-split system satisfying the defrosting requirement;

step (2b): if the defrosting requirement is not satisfied under a condition that each of the expansion valves of the working indoor units are closed and the opening degree of each of the expansion valves of the off-state indoor units≤the maximum set opening degree offLimitMaxPLS;

adjusting the opening degree of each of the expansion valves of the off-state indoor units to the maximum set opening degree offLimitMaxPLS; and adjusting the opening degree of each of the expansion valves of the working indoor units to On_PLS;

wherein On_PLS=(ALL_HP*Avg_PLS-Off_HP*offLimitMaxPLS)/On_HP;

in which On_HP denoting the total capacity of the working indoor units and On_PLS denoting the opening degree of each of the expansion valves of the working indoor units.

2. A defrosting control method for multi-split system according to claim 1, wherein determining whether or not satisfying the defrosting requirement by determining if under a condition that the expansion valves of the working indoor units are closed and the opening degree of each of the expansion valves of the off-state indoor units≤the maximum set opening degree offLimitMaxPLS by determining whether (Off_HP*offLimitMaxPLS) ≥ALL_HP*Avg_PLS.

3. A defrosting control method for multi-split system according to claim 1, further comprising:

separating the indoor units into normal indoor units and VIP indoor units; and in step (2b), if the defrosting requirement is not satisfied under a condition that each of the expansion valves of the working indoor units are closed and the opening degree of each of the expansion valves of the off-state indoor units≤the maximum set opening degree offLimitMaxPLS, then further determining whether or not the defrosting requirement is satisfied under a condition that the opening degree of each of the expansion valves of the off-state indoor units is the maximum set opening degree offLimitMaxPLS, the opening degree of each of expansion valves of working normal indoor units≤a maximum set opening degree onLimitMaxPLS, and each of expansion valves of working VIP indoor units are closed;

step (2b1): if the defrosting requirement is satisfied, adjusting the opening degree of each of the expansion valves of the off-state indoor units to the maximum set opening degree offLimitMaxPLS; adjusting the opening degree of each of the expansion valves of the working normal indoor units to a NormalOn_PLS; wherein NormalOn_PLS=(ALL_HP*Avg_PLS-Off_HP*offLimitMaxPLS)/NormalOn_HP;

and closing each of the expansion valves of the working VIP indoor units;

in which, NormalOn_HP denoting a total capacity of the working normal indoor units; NormalOn_PLS denoting the opening degree of each of the expansion valves of the working normal indoor units, and onLimitMaxPLS denoting a maximum set opening degree of each of the expansion valves of the normal working indoor units;

step (2b2): if the defrosting requirement is not satisfied under the condition that the opening degree of each of the expansion valves of the off-state indoor units is the maximum set opening degree offLimitMaxPLS, the opening degree of each of expansion valves of the working normal indoor units≤the maximum set opening degree onLimitMaxPLS, and each of expansion valves of working VIP indoor units are closed:

adjusting the opening degree of each of the expansion valves of the off-state indoor units to the maximum set opening degree offLimitMaxPLS;

adjusting the opening degree of each of the expansion valves of the working normal indoor units to the maximum set opening degree onLimitMaxPLS; and adjusting the opening degree of each of the expansion valves of the working VIP indoor units to VIP_PLS, wherein VIP_PLS=(ALL_HP*Avg_PLS-Off_HP*offLimitMaxPLS-NormalOn_HP*onLimit MaxPLS)/VIP_HP;

in which, VIP_HP denoting a total capacity of the working VIP indoor units;

VIP_PLS denoting an opening degree of each of the expansion valves of the working VIP indoor units.

4. A defrosting control method for multi-split system according to claim 3, wherein the step for determining whether or not the defrosting requirement is satisfied under the condition that the opening degree of each of the expansion valves of the off-state indoor units is the maximum set opening degree offLimitMaxPLS, the opening degree of each of expansion valves of the working normal indoor units≤a maximum set opening degree onLimitMaxPLS, and each of expansion valves of working VIP indoor units are closed includes:

determining whether (Off_HP*offLimitMaxPLS)+(NormalOn_HP*onLimitMaxPLS) ≥ALL_HP*Avg_PLS.

5. A defrosting control method for multi-split system according to claim 1, wherein the maximum set opening degree of each of the expansion valves of the off-state indoor units offLimitMaxPLS=K1*Avg_PLS, 2≤K1≤3.

6. A defrosting control method for multi-split system according to claim 5, wherein K1=2.

7. A defrosting control method for multi-split system according to claim 3, wherein the maximum set opening degree of each of the expansion valves of the working normal indoor units onLimitMaxPLS=K2*Avg_PLS, 1≤K2<2.

8. A defrosting control method for multi-split system according to claim 7, wherein K2=1.5.

* * * * *